US008204422B2

(12) United States Patent
Hatori et al.

(10) Patent No.: US 8,204,422 B2
(45) Date of Patent: Jun. 19, 2012

(54) IMAGE FORMING APPARATUS AND PROCESS CARTRIDGE HAVING A CHARGING UNIT

(75) Inventors: Satoshi Hatori, Yokohama (JP); Yasushi Akiba, Yokohama (JP); Kaoru Yoshino, Tokyo (JP); Takaya Muraishi, Kawasaki (JP); Akio Kosuge, Yokohama (JP); Takeshi Shintani, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 724 days.

(21) Appl. No.: 12/167,564

(22) Filed: Jul. 3, 2008

(65) Prior Publication Data

US 2009/0010693 A1 Jan. 8, 2009

(30) Foreign Application Priority Data

Jul. 5, 2007 (JP) ..... 2007-177027

(51) Int. Cl.
*G03G 21/00* (2006.01)
*G03G 21/16* (2006.01)

(52) U.S. Cl. ..... 399/346; 399/111; 399/168

(58) Field of Classification Search ..... 399/346, 399/111, 168, 344, 343, 71, 112
See application file for complete search history.

(56) References Cited

U.S. PATENT DOCUMENTS

| | | | | |
|---|---|---|---|---|
| 6,295,438 | B1 * | 9/2001 | Fujishiro et al. | 399/346 |
| 6,768,879 | B2 | 7/2004 | Kosuge | |
| 6,775,511 | B2 | 8/2004 | Kosuge | |
| 7,149,465 | B2 | 12/2006 | Amemiya et al. | |
| 7,209,699 | B2 | 4/2007 | Yamaguchi et al. | |
| 7,228,099 | B2 | 6/2007 | Shintani et al. | |
| 7,302,197 | B2 | 11/2007 | Kosuge | |
| 7,313,347 | B2 | 12/2007 | Shintani et al. | |
| 7,542,712 | B2 | 6/2009 | Tanaka et al. | |
| 7,715,761 | B2 * | 5/2010 | Uda et al. | 399/168 |
| 7,894,758 | B2 * | 2/2011 | Shintani et al. | 399/346 |
| 2005/0084271 | A1 | 4/2005 | Koike et al. | |

(Continued)

FOREIGN PATENT DOCUMENTS

EP 1 903 406 A2 3/2008

(Continued)

OTHER PUBLICATIONS

U.S. Appl. No. 11/223,923, filed Sep. 13, 2005, Masanori Kawasumi.

(Continued)

*Primary Examiner* — Susan Lee
(74) *Attorney, Agent, or Firm* — Oblon, Spivak, McClelland, Maier & Neustadt, L.L.P.

(57) ABSTRACT

An image forming apparatus includes a plurality of process cartridges provided for black and for another color. The process cartridges each including a set of a latent image carrier, a charging unit that charges a surface of the latent image carrier, and a lubricant applying unit that applies lubricant to the surface of the latent image carrier. The process cartridges for black and for the another color each has a cartridge frame with which the process cartridge is attachable to and removable from an apparatus body. The cartridge frames of the process cartridges for black and for the another color being of the same type. The process cartridge for black differs from the process cartridge for the another color in the configuration of the charging unit. The amounts of lubricant applied by the lubricant applying units to the respective latent image carriers differ with respect to the configuration of the charging unit.

20 Claims, 7 Drawing Sheets

U.S. PATENT DOCUMENTS

| | | | | |
|---|---|---|---|---|
| 2005/0164108 | A1 | 7/2005 | Murakami et al. | |
| 2007/0036595 | A1 | 2/2007 | Amemiya et al. | |
| 2007/0071525 | A1 | 3/2007 | Yoshino et al. | |
| 2007/0154246 | A1 | 7/2007 | Shintani et al. | |
| 2008/0013986 | A1 | 1/2008 | Kosuge | |
| 2008/0069614 | A1 | 3/2008 | Shintani et al. | |
| 2008/0069615 | A1* | 3/2008 | Shintani et al. | 399/346 |

FOREIGN PATENT DOCUMENTS

| | | |
|---|---|---|
| JP | UM60-125004 | 8/1985 |
| JP | 2000-338819 | 12/2000 |
| JP | 2001-51467 | 2/2001 |
| JP | 2001-324843 | 11/2001 |
| JP | 2002-341694 | 11/2002 |
| JP | 2003-330320 | 11/2003 |
| JP | 2004-61855 | 2/2004 |
| JP | 2004-151612 | 5/2004 |
| JP | 3587094 | 8/2004 |
| JP | 2005-84292 | 3/2005 |
| JP | 2005-215307 | 8/2005 |
| JP | 2005-309406 | 11/2005 |
| JP | 2005-321833 | 11/2005 |
| JP | 2005-346028 | 12/2005 |
| JP | 2006-30955 | 2/2006 |
| JP | 2006-113499 | 4/2006 |
| JP | 2007-108681 | 4/2007 |
| JP | 2007-133117 | 5/2007 |
| JP | 2007-147917 | 6/2007 |

OTHER PUBLICATIONS

Japanese Office Action mailed Oct. 26, 2011 in counterpart Japanese Patent Application No. 2007-177027.

* cited by examiner

IMAGE FORMING APPARATUS AND PROCESS CARTRIDGE HAVING A CHARGING UNIT

CROSS-REFERENCE TO RELATED APPLICATION

This application claims priority to Japanese Patent Application No. 2007-177027, filed on Jul. 5, 2007, the entire contents of each of which are hereby incorporated by reference herein.

BACKGROUND

1. Field

The present invention relates to image forming apparatuses and process cartridges, and in particular to image forming apparatuses and process cartridges that include and serve as imaging devices for forming images in black and for forming images in other colors, the imaging devices for forming images in black and for other colors each including a latent image carrier, a charging unit that charges the surface of the latent image carrier, and a lubricant applying unit that applies lubricant to the surface of the latent image carrier.

2. Background Art

Latent image carriers included in imaging devices need to be uniformly charged by respective charging units so as to have latent images formed thereon. The charging units each includes a charging member such as a charging wire, a roller, or a brush. Other examples of the charging member include a non-contact charging member that charges the surface of the latent image carrier spaced apart therefrom, and a contact charging member that charges the surface of the latent image carrier being in contact therewith. Charging biases to be applied to such a charging member also vary, such as a bias that includes only a direct current (DC) component, and a bias that includes a DC component and an alternating current (AC) component superposed thereon.

Charging units employing a charging wire as the charging member are not in contact with the surfaces of the latent image carriers and employ the DC charging method in which a charging bias including only a DC component is applied. Such charging units employing the DC charging method cause no hazard to the surfaces of the latent image carriers and therefore are advantageous in preventing surface peeling of the latent image carriers and in extending the lifetimes of the latent image carriers. Moreover, since such charging units are of the non-contact type, contaminants on the latent image carriers do not adhere to their charging members. However, there is a problem in that such charging units tend to generate ozone and nitrogen oxides (NOx) during charging.

Examples of a charging member in the form of a charging roller are classified into the following: a non-contact charging roller type in which the surface of the latent image carrier is charged without being in contact with the roller, and a contact charging roller type in which the surface of the latent image carrier is charged while being in contact with the roller. Non-contact charging rollers apply a charging bias by the AC+DC charging method in which a DC component and an AC component superposed thereon are applied. Contact charging rollers apply a charging bias by either the DC charging method in which only a DC component is applied or the AC+DC charging method in which a DC component and an AC component superposed thereon are applied.

Charging units of the non-contact charging roller type generate less ozone and NOx during charging than charging units of the charging wire type. In addition, contaminants on the latent image carriers infrequently adhere to the non-contact charging members, i.e., the charging rollers. However, there is a problem in that superposition of an AC component is highly hazardous to the surface of each latent image carrier. This increases the probability of surface peeling of the latent image carrier and thus shortens the lifetime of the latent image carrier.

Charging units employing the contact charging roller and the DC charging method have a simple configuration and are not hazardous to the surfaces of the latent image carriers. Therefore, such charging units are advantageous in preventing surface peeling of the latent image carriers and in extending the lifetimes of the latent image carriers. However, because of direct contact with the latent image carriers, contaminants on the latent image carriers easily adhere to the surfaces of the respective charging rollers. The contaminated portion of each charging roller may cause irregular charging leading to deterioration in image quality. In contrast, charging units employing the contact charging roller and the AC+DC charging method less frequently cause irregular charging than charging units employing the contact charging roller and the DC charging method, even if the charging roller is contaminated, because of the superposition of an AC component. However, the superposition of an AC component is highly hazardous to the surface of each latent image carrier. This increases the probability of surface peeling of the latent image carriers and thus shortens the lifetimes of the latent image carriers.

Charging units of imaging devices included in a full-four-color image forming apparatus have the following characteristics according to their configurations. In the case where a single imaging device includes a charging wire as the charging member, the amount of ozone to be generated is smaller than that in the case where all of the four imaging devices each includes a charging wire. Therefore, emission of ozone from the inside to the outside of the image forming apparatus can be suppressed. In this case where a single imaging device includes a charging wire, the amount of NOx to be generated is also smaller and thus the probability of occurrence of image distortion is smaller than in the case where all of the four imaging devices each includes a charging wire. Therefore, adverse influence on images can be suppressed to a negligible level. On the other hand, when a charging unit employing the contact charging roller and the DC charging method is applied to an imaging device that forms a black toner image (hereinafter referred to as an imaging device for black), image irregularity due to contamination of the charging roller is not noticeable and can be ignored in practical use. However, when the same charging unit is applied to imaging devices that form color toner images (hereinafter referred to as imaging devices for color), image irregularity due to contamination of the charging rollers is noticeable and may cause a problem in practical use.

When a charging unit employing the contact or non-contact charging roller and the AC+DC charging method is applied to imaging devices for color, which are used infrequently, the short lifetimes of the latent image carriers do not matter very much. However, when the same charging unit is applied to an imaging device for black, which is used frequently, the short lifetime of the corresponding latent image carrier may cause a problem in practical use.

To summarize, application of charging units having the same configuration to all of the imaging devices for four colors in a full-color image forming apparatus may cause problems in practical use. To solve such problems, there are some known image forming apparatuses in which at least one of a plurality of imaging devices includes a charging unit having a configuration different from those of the charging units included in the other imaging devices.

For example, in an image forming apparatus, a charging unit employing a charging wire is applied to the imaging device for black, and a charging unit employing a non-contact charging roller and the AC+DC charging method is applied to the imaging devices for color. Since only one of the charging units employs a charging wire, emission of ozone and image distortion caused by NOx are suppressed while the latent image carrier of the imaging device for black, which is used frequently, can be provided with a sufficient lifetime. In addition, since the charging unit employing the non-contact charging roller and the AC+DC charging method is only applied to the imaging devices for color, which are used infrequently, the problem that the lifetimes of the latent image carriers may be shortened because of the AC component that is hazardous thereto is negligible in practical use.

Moreover, since both charging units are of the non-contact type, contaminants on the latent image carriers infrequently adhere to the charging rollers. Accordingly, there is practically no problem due to contamination of the charging rollers.

Further, when a charging unit employing the contact charging roller and the DC charging method is applied to an imaging device for black, image irregularity due to contamination of the corresponding charging roller is not noticeable. Therefore, it is also allowable that a charging unit employing the contact charging roller and the DC charging method is applied to the imaging device for black while a charging unit employing the non-contact charging roller and the AC+DC charging method is applied to the imaging devices for color. That is, by applying charging units having different configurations to imaging devices according to the characteristics of the imaging devices, an image forming apparatus that infrequently has problems in practical use can be realized.

Under such circumstances, there is a known image forming apparatus in which lubricant is applied to the surfaces of latent image carriers from the viewpoints of suppressing surface peeling of the latent image carriers, improving removability of post-transfer residual toner on the latent image carriers, and preventing strong adhesion of toner components to the surfaces of the latent image carriers, which is called filming.

Even in the case where lubricant is applied to the surfaces of the latent image carriers as described above while charging units of the contact or non-contact charging roller type are used, a small amount of lubricant may adhere to the charging rollers. Consequently, irregular charging may occur at some portions of the charging rollers after a certain period of use, leading to deterioration in image quality.

Although color image forming apparatuses have become popular in recent years, the situation where color image forming apparatuses are always used in a full color mode is not so common yet, practically. Black-and-white images are still used in most cases. Therefore, among imaging devices for forming images in a plurality of colors, the imaging device for black has the shortest lifetime. Naturally, users are eagerly demanding that the lifetime of the imaging device for black be extended. In response to such a demand, an image forming apparatus including a DC charger in the imaging device for black and AC+DC charging rollers in the imaging devices for color has been realized and is becoming popular.

In such a case, use of a DC charger for black is less hazardous to a photoconductor, extends the lifetime of a cleaning blade, and reduces the occurrence of failure due to contamination caused by a lubricant applying unit. This is because the DC charger is spaced apart farther from the image carrier and therefore is less frequently contaminated than in the case of an AC+DC charging roller.

In addition, use of AC+DC charging rollers for color suppresses generation of ozone and reduces the space, such as an airflow path, necessary for ozone management, leading to size reduction of the image forming apparatus. Consequently, the imaging device for black has a longer lifetime than the imaging devices for color. Thus, an image forming apparatus that matches the current trend in which black-and-white images are used frequently can be provided.

Further, use of a DC charger for black is less hazardous to the photoconductor than use of AC+DC charging rollers for color. Therefore, the amount of lubricant to be applied by the lubricant applying unit can be reduced. This means that the lubricant applying unit for black having lubricant of the same amount as those of the lubricant applying units for color can be used longer than those for color.

Considering such circumstances, there is another example in which the amounts of lubricant to be applied by respective lubricant applying units are intentionally made different for the case for black and the case for color according to the charging method.

When different charging methods are employed for the imaging device for black and the imaging devices for color as described above with the proviso that dedicated process cartridges, serving as imaging devices, are used respectively for black and for color, the production cost will be increased.

SUMMARY

This patent specification describes a novel image forming apparatus includes a plurality of process cartridges provided for black and for another color. The process cartridges each including a set of a latent image carrier, a charging unit that charges a surface of the latent image carrier, and a lubricant applying unit that applies lubricant to the surface of the latent image carrier. The process cartridges for black and for the another color each has a cartridge frame with which the process cartridge is attachable to and removable from an apparatus body. The cartridge frames of the process cartridges for black and for the another color being of the same type. The process cartridge for black differs from the process cartridge for the another color in the configuration of the charging unit. The amounts of lubricant applied by the lubricant applying units to the respective latent image carriers differ with respect to the configuration of the charging unit.

This patent specification further describes a process cartridge used for formation of an image of black or of another color. The process cartridge includes a set of a latent image carrier, a charging unit that charges a surface of the latent image carrier, and a lubricant applying unit that applies lubricant to the surface of the latent image carrier. The process cartridge has a cartridge frame with which the process cartridge is attachable to and removable from an apparatus body, the cartridge frame being of the same type for both cases where the process cartridge is used for black and the another color. The configuration of the charging unit differs between a case where the process cartridge is used for black and a case where the process cartridge is used for the another color, and the amount of lubricant to be applied by the lubricant applying unit to the latent image carrier differs with respect to the configuration of the charging unit.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
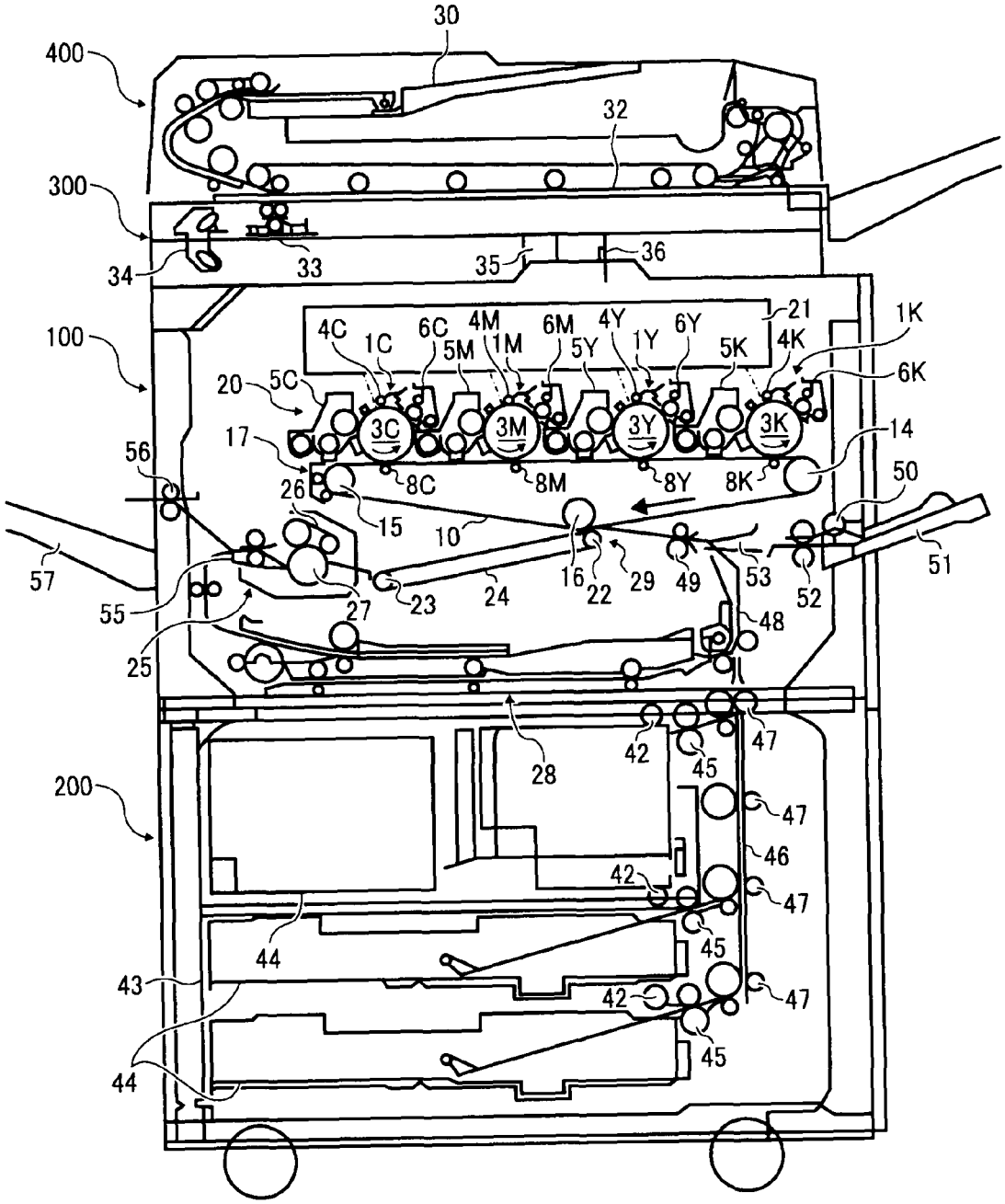
FIG. 1 is a schematic diagram of a color copier serving as an image forming apparatus according to an exemplary embodiment.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, a description is given of an example embodiment.

An exemplary embodiment in which the invention is applied to a tandem color image forming apparatus will be described. FIG. 1 is a schematic diagram of a color copier serving as an image forming apparatus according to the exemplary embodiment. This copier includes a copier body (hereinafter referred to as a printer section 100), a paper feed table (hereinafter referred to as a paper feed section 200), a scanner (hereinafter referred to as a scanner section 300) mounted on the printer section 100, and an automatic document feeder (ADF, hereinafter referred to as a document feed section 400) mounted on the scanner section 300. The copier also includes a control section (not shown) that controls operations of the sections included in the copier.

The printer section 100 includes in its central portion an intermediate transfer belt 10 as an intermediate transfer member. The intermediate transfer belt 10 is stretched between a first support roller 14, a second support roller 15, and a third support roller 16, and is movable therearound clockwise in FIG. 1. Four photoconductors 3K, Y, M, and C serving as latent image carriers that carry on their surfaces toner images of black, yellow, magenta, and cyan, respectively, are provided facing the intermediate transfer belt 10. The photoconductors 3K, Y, M, and C are provided therearound with chargers 4K, Y, M, and C serving as charging units that uniformly charge the surfaces of the respective photoconductors 3K, Y, M, and C; developers 5K, Y, M, and C serving as developing units that develop toner images; and lubricant applicators 6K, Y, M, and C serving as lubricant applying units that apply lubricant to the surfaces of the respective photoconductors 3K, Y, M, and C. The lubricant applicators 6K, Y, M, and C each has a photoconductor cleaning member serving as a cleaner that removes residual toner on the surface of corresponding one of the photoconductors 3K, Y, M, and C after a primary transfer.

The photoconductors 3K, Y, M, and C, the developers 5K, Y, M, and C, the chargers 4K, Y, M, and C, and the lubricant applicators 6K, Y, M, and C constitute imaging devices 1K, Y, M, and C, respectively, serving as image forming units. The four imaging devices 1K, Y, M, and C are arranged side by side, thereby constituting a tandem image forming unit 20. A belt cleaner 17 is provided facing the second support roller 15 with the intermediate transfer belt 10 nipped therebetween. The belt cleaner 17 removes residual toner on the intermediate transfer belt 10 after a toner image is transferred onto transfer paper, or a recording medium. The printer section 100 further includes an exposure unit 21 above the tandem image forming unit 20.

Primary transfer rollers 8K, Y, M, and C are provided on the inner periphery of the intermediate transfer belt 10 at positions facing the photoconductors 3K, Y, M, and C, respectively, with the intermediate transfer belt 10 nipped therebetween. The primary transfer rollers 8K, Y, M, and C are pressed against the photoconductors 3K, Y, M, and C with the intermediate transfer belt 10 interposed therebetween, thereby forming primary transfer parts.

A secondary transfer unit 29 is provided across the intermediate transfer belt 10 from the tandem image forming unit 20. The secondary transfer unit 29 is constituted by a secondary transfer roller 22, a secondary-transfer-belt stretching roller 23, and a secondary transfer belt 24 stretched therebetween. The secondary transfer unit 29 is configured in such a manner that the secondary transfer belt 24 is pressed against the third support roller 16 with the intermediate transfer belt 10 interposed therebetween at a position where the secondary transfer roller 22 supports the secondary transfer belt 24. In this manner, a secondary transfer nip, i.e., a secondary transfer part, is formed between the secondary transfer belt 24 and the intermediate transfer belt 10.

A fusing unit 25 that fuses an image transferred onto the transfer paper is provided on the left side of the secondary transfer unit 29 in FIG. 1. The fusing unit 25 is constituted by a fusing belt 26, which is an endless belt, and a pressing roller 27 that is pressed against the fusing belt 26. The secondary transfer unit 29 also has a transfer paper conveying function for conveying to the fusing unit 25 the transfer paper on which a toner image has been transferred at the secondary transfer nip. The secondary transfer unit 29 may also include a component such as a transfer roller or a non-contact charger. In such a case, however, it is difficult to provide the secondary transfer unit 29 with the transfer paper conveying function.

A transfer paper reversing unit 28 is provided below the secondary transfer unit 29 and the fusing unit 25, and parallel to the tandem image forming unit 20. The transfer paper reversing unit 28 reverses the transfer paper so that images can be recorded on both sides of the transfer paper. With such a configuration, the following operation can be realized. After an image is fused on one side of the transfer paper, the transfer paper is redirected by a redirecting tab toward the transfer paper reversing unit 28. The transfer paper is reversed by the transfer paper reversing unit 28 and is conveyed back to the secondary transfer nip. Then, after a toner image is transferred, the transfer paper is ejected onto an output tray.

The scanner section 300 reads image information of a document placed on a contact glass 32 by using a read sensor 36, and sends the read image information to the control section.

In accordance with the image information received from the scanner section 300, the control section (not shown) causes a laser or a light-emitting diode (LED) (not shown), for example, included in the exposure unit 21 of the printer section 100 to irradiate the photoconductors 3 with a laser writing beam L. With this irradiation, electrostatic latent images are formed on the surfaces of the photoconductors 3. These latent images are developed into a toner image through a predetermined developing process.

The paper feed section 200 includes paper feed cassettes 44 provided at different levels in a paper bank 43, paper feed rollers 42 delivering transfer paper P from the respective paper feed cassettes 44, separating rollers 45 separating the delivered transfer paper P piece by piece and sending each piece of the transfer paper P to a paper feed path 46, conveying rollers 47 conveying the transfer paper P to a paper feed path 48 in the printer section 100, and so forth.

The copier of the exemplary embodiment is capable of feeding paper both through the paper feed section 200 and by hand. The copier includes on its side face a manual feed tray 51 provided for feeding the paper by hand, a paper feed roller 50 delivering the transfer paper P from the manual feed tray 51, and separating rollers 52 separating the delivered transfer paper P piece by piece and sending each piece of transfer paper P to a manual feed path 53.

Registration rollers 49 allow only one piece of transfer paper P from one of the paper feed cassettes 44 or the manual feed tray 51 to be delivered to the secondary transfer nip provided between the intermediate transfer belt 10, serving as the intermediate transfer member, and the secondary transfer unit 29.

In the copier of the exemplary embodiment, to make a copy of a color image, a desired document is set on a document table 30 of the document feed section 400. Alternatively, the document feed section 400 is opened, a desired document is set on the contact glass 32 of the scanner section 300, and the document feed section 400 is closed so as to press the document.

Then, by pressing a start switch (not shown), the scanner section 300 is activated after the document is fed onto the contact glass 32 if the document is set on the document feed section 400, or immediately if the document is set on the contact glass 32. When the scanner section 300 is activated, a first scanning member 33 and a second scanning member 34 are moved. The first scanning member 33 emits light from its light source while receiving the light reflected from the surface of the document and deflecting the light to the second scanning member 34. The second scanning member 34 reflects with its mirror the deflected light in such a manner that the light travels through an image forming lens 35 and enters the read sensor 36. Thus, the image information of the document is read.

The chargers 4K, Y, M, and C uniformly charge the surfaces of the respective photoconductors 3K, Y, M, and C. The image information read by the scanner section 300 is subjected to color separation. The exposure unit 21 performs laser writing on the photoconductors 3K, Y, M, and C in correspondence with their colors. Thus, electrostatic latent images are formed on the surfaces of the respective photoconductors 3K, Y, M, and C. For example, image formation in the case of cyan (C) will be described. In conformity with the electrostatic image formed on the surface of the photoconductor 3C, C toner is developed by the developer 5C, whereby a monochrome toner image is formed. Likewise, monochrome toner images for magenta (M), yellow (Y), and black (K) are formed in that order on the respective photoconductors 3 in the imaging devices 1M, Y, and K. While the toner images are formed on the respective photoconductors 3, one of the four paper feed rollers is driven so as to feed a piece of transfer paper of a size matching the image information.

At the same time, one of the first support roller 14, the second support roller 15, and the third support roller 16 is rotatably driven by a driving motor (not shown) with the other two support rollers being caused to rotate following the driven one, whereby the intermediate transfer belt 10 is conveyed therearound. While the intermediate transfer belt 10 is conveyed, the monochrome toner images on the photoconductors 3C, M, Y, and K are sequentially transferred to the intermediate transfer belt 10, whereby a composite color image is formed on the intermediate transfer belt 10.

In the paper feed section 200, one of the paper feed rollers 42 is selectively rotated and the transfer paper P is delivered from the corresponding one of the paper feed cassettes 44. The separating rollers 45 separate the transfer paper P piece by piece and introduce each piece of transfer paper P into the paper feed path 46. The conveying rollers 47 guide the piece of transfer paper P into the paper feed path 48 in the printer section 100, which is the copier main body, until the piece of transfer paper P is stopped at the registration rollers 49. Alternatively, the transfer paper P on the manual feed tray 51 is delivered by rotating the paper feed roller 50. Then, likewise, the separating rollers 52 separate the transfer paper P piece by piece and guide each piece of transfer paper P into the manual feed path 53 until the piece of transfer paper P is stopped at the registration rollers 49.

Subsequently, with a timing that matches the conveyance of the intermediate transfer belt 10 carrying the composite color image, the registration rollers 49 are rotated and thus the piece of transfer paper P is fed into the secondary transfer nip, which is the contact part between the intermediate transfer belt 10 and the secondary transfer roller 22. Then, the composite color image is subjected to secondary transfer under the influences of, for example, a transfer electric field and a contact pressure produced at the nip, whereby the color image is recorded on the piece of transfer paper P.

The piece of transfer paper P that has been subjected to transfer of the color image at the secondary transfer nip is conveyed to the fusing unit 25 by the secondary transfer belt 24 of the secondary transfer unit 29. In the fusing unit 25, the color image is fused with a pressure and a heat applied by the pressing roller 27 and the fusing belt 26. Then, the piece of transfer paper P is ejected by ejecting rollers 56 and is stacked on the output tray 57. In the case where images are formed on both sides of a piece of transfer paper P, the piece of transfer paper P that has been subjected to fusing of a color image is redirected by the redirecting tab 55, is conveyed to the transfer paper reversing unit 28, is reversed by the transfer paper reversing unit 28, and is guided back to the secondary transfer nip, where another image is recorded on the back surface. Then, the piece of transfer paper P is ejected by the ejecting rollers 56 onto the output tray 57.

On the other hand, the belt cleaner 17 removes residual toner on the surface of the intermediate transfer belt 10 from which the color image has been transferred onto the piece of transfer paper P at the secondary transfer nip. Thus, the intermediate transfer belt 10 is prepared for the next image formation performed by the tandem image forming unit 20.

Figure 2A:
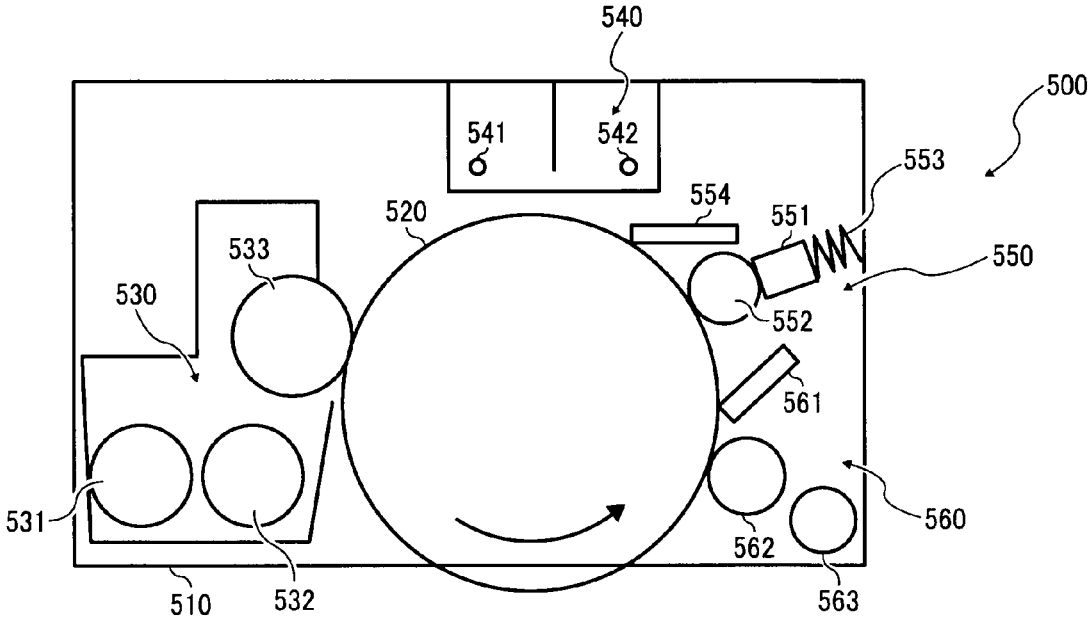
FIG. 2A is a schematic cross-sectional view of a process cartridge for black according to a first embodiment.
Figure 2B:
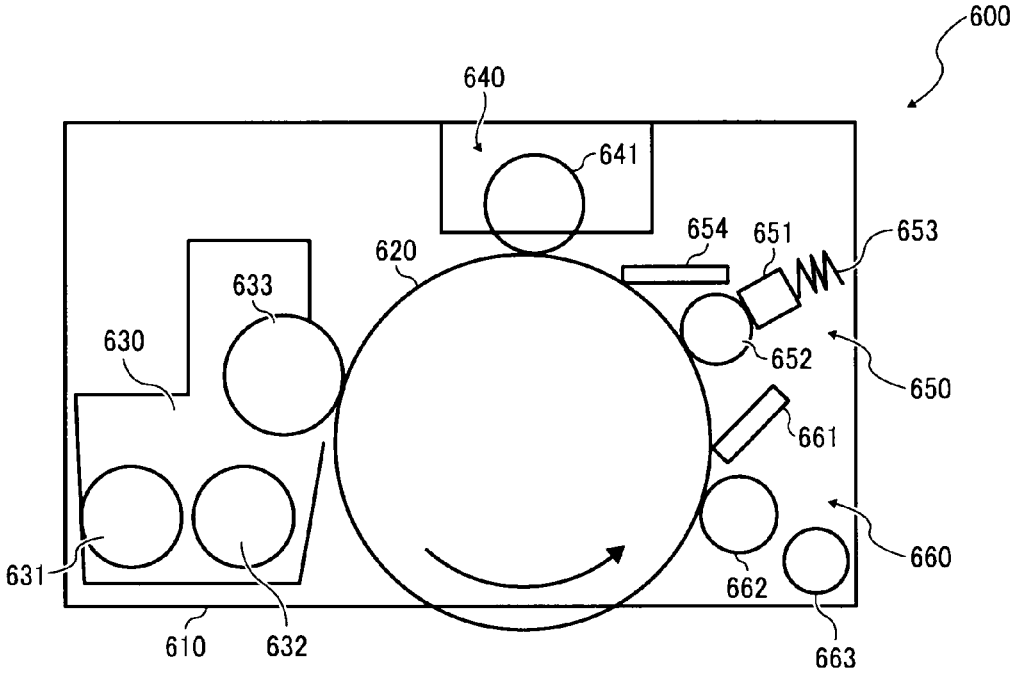
FIG. 2B is a schematic cross-sectional view of a process cartridge for yellow according to the first embodiment.

Now, process cartridges of the image forming apparatus according to the invention will be described. FIGS. 2A and 2B each shows a process cartridge according to a first embodiment. FIG. 2A is a schematic cross-sectional view of a process cartridge for black. FIG. 2B is a schematic cross-sectional view of a process cartridge for yellow.

First, a process cartridge 500 for black will be described. The process cartridge 500 for black has a frame 510, in which a photoconductor drum 520 serving as an image carrier, a developer 530, a charger 540, a lubricant applicator 550, and a cleaner 560 are arranged.

The frame 510 has the same configuration as that of a frame 610 of a process cartridge 600 for yellow described separately below.

The developer 530 includes stirring rollers 531 and 532 that stir toner, and a magnetic drum 533 that applies toner to the photoconductor drum 520. The charger 540 includes a charge wire 541 and employs a DC charging method.

The lubricant applicator 550 includes a solid lubricant 551, a lubricant applying member 552, such as a brush drum, that scrapes the solid lubricant 551 and applies the scraped lubricant to the photoconductor drum 520 while being in contact with both the solid lubricant 551 and the photoconductor drum 520, a spring 553 serving as a pressing member that presses the solid lubricant 551 against the lubricant applying member 552, and an application blade 554 that evenly spreads the applied lubricant. The spring 553 is provided in a number of two in the longitudinal direction of the lubricant applying member 552. As described separately below, the spring 553 included in the lubricant applicator 550 has a pressing force smaller than that of a spring 653 included in a lubricant applicator 650 of the process cartridge 600 for yellow. Thus, even in the case where the same lubricant is used in all of the lubricant applicators, the process cartridge 500 for black can have a longer lifetime than those of the process cartridges for color including yellow.

The cleaner 560 includes a cleaning blade 561 that collects toner while being in contact with the photoconductor drum 520, a cleaning brush 562 that is rotatably in contact with the photoconductor drum 520, and a conveying screw 563 that conveys the collected toner.

To summarize, the process cartridge 500 for black includes the charger 540 employing a DC charging method and provides long lifetimes with the lubricant applicator, the image carrier, and the cleaning blade, because of the reduced amount of the lubricant to be applied. Since process cartridges for black are frequently used, such extension of component lifetimes can satisfy the demand of users.

Next, process cartridges for color, i.e., Y; M; and C, in particular the process cartridge 600 for yellow, will be described. The process cartridge 600 for yellow has the frame 610 that has the same configuration as that of the frame 510 of the process cartridge 500 for black. In the frame 610, a photoconductor drum 620 serving as an image carrier, a developer 630, a charger 640, the lubricant applicator 650, and a cleaner 660 are arranged.

As described above, the frame 610 has the same configuration as that of the frame 510 of the process cartridge 500 for black. In other words, the process cartridge 500 for black and the process cartridge 600 for yellow can be provided with frames of the same type. Hence, there is no need to prepare separate frames dedicated respectively for black and for color. Consequently, commonality of the frame in terms of the mold, production line, and component management can be realized. This is advantageous in cost reduction.

The developer 630 includes stirring rollers 631 and 632 that stir toner, and a magnetic drum 633 that applies toner to the photoconductor drum 620. The charger 640 includes a charging roller 641 and employs an AC+DC charging method.

In the process cartridge 600 for yellow, since the charger 640 employs the AC+DC charging method, emission of ozone can be reduced. Accordingly, the ozone management mechanism can be simplified, whereby the cartridge size can be reduced.

The lubricant applicator 650 includes a solid lubricant 651, a lubricant applying member 652, such as a brush drum, that scrapes the solid lubricant 651 and applies the scraped lubricant to the photoconductor drum 620 while being in contact with both the solid lubricant 651 and the photoconductor drum 620, the spring 653 serving as a pressing member that presses the solid lubricant 651 against the lubricant applying member 652, and an application blade 654 that evenly spreads the applied lubricant. As described above, the lubricant applicator 650 has the same configuration as that of the lubricant applicator 550 included in the process cartridge 500 for black, except that the spring 653 has a pressing force larger than that of the spring 553. The spring 653 is provided in a number of two in the longitudinal direction of the lubricant applying member 652 (see FIG. 4).

The lubricant applicator 650 has a configuration similar to that of the lubricant applicator 550 included in the process cartridge 500 for black. In the first embodiment, the lubricant applicator 550 of the process cartridge 500 for black and the lubricant applicator 650 of the process cartridge 600 for yellow include the spring 553 and the spring 653, respectively, having different pressing forces, as described separately below.

The cleaner 660 includes a cleaning blade 661 that collects toner while being in contact with the photoconductor drum 620, a cleaning brush 662 that is rotatably in contact with the photoconductor drum 620, and a conveying screw 663 that conveys the collected toner.

Figure 3:
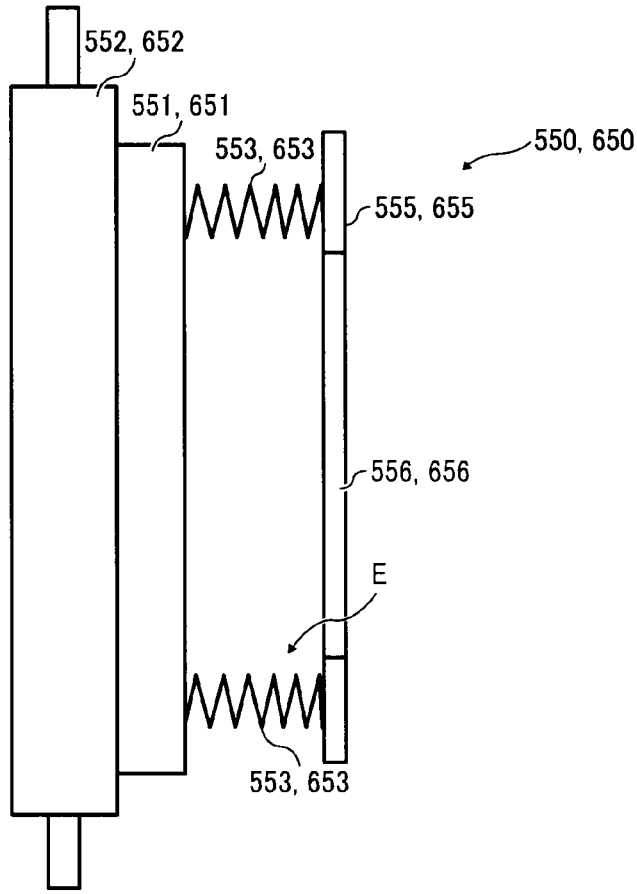
FIG. 3 is a plan view showing a lubricant applicator.
Figure 4:
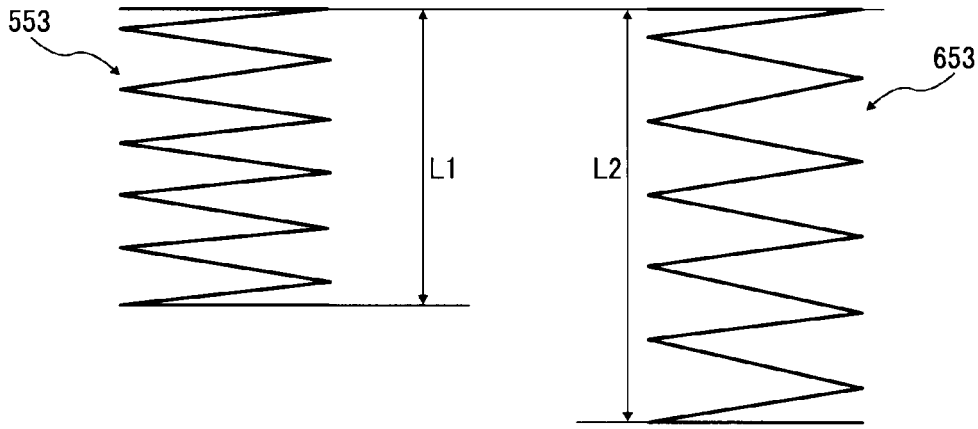
FIG. 4 shows springs, one of which is included in the lubricant applicator shown in FIG. 3.

Next, the lubricant applicators 550 and 650 will be described. FIG. 3 is a plan view showing a lubricant applicator. FIG. 4 shows springs, one of which is included in the lubricant applicator shown in FIG. 3. In the first embodiment, the lubricant applicators 550 and 650 have the same configuration, as shown in FIG. 3, except that the springs 553 and 653 have different pressing forces. Referring to FIG. 3, the solid lubricant 551 or 651 in the lubricant applicator 550 or 650 has almost the same length as that of the photoconductor drum 520 or 620. To uniformly press the solid lubricant 551 or 651 against the lubricant applying member 552 or 652, the spring 553 or 653 is provided in a number of two. Further, in the first embodiment, to make the amount of lubricant to be applied by the lubricant applicator 550 in the process cartridge 500 for black smaller than that in the process cartridge 600 for yellow, the spring 553 of the process cartridge 500 for black is formed with a length L1, and the spring 653 of the process cartridge 600 for yellow, an example of the process cartridges for color, is formed with a length L2. That is, the springs 553 and 653 of two different kinds are prepared so that either of the two can be selected in accordance with the type of the lubricant applicator to be used, i.e., the lubricant applicator 550 or 650.

The springs selected for the lubricant applicators 550 and 650 are respectively mounted therein by being compressed so as to have the same length, whereby the pressing force of the spring 553 of the process cartridge 500 for black is made smaller than that of the spring 653 of the process cartridge 600 for yellow. In addition, it is desirable that the surface of the spring 553 to be used in the process cartridge 500 for black and the surface of the spring 653 to be used in the process cartridge 600 for yellow be colored differently. With such different surface colors of the springs, the different kinds of springs can be distinguished from each other easily.

This way of coloring also contributes to distinguishing between various imaging devices (in a state of not having chargers mounted thereon) for black and for color in the manufacturing process, whereby confusion can be prevented and maintenance in the market can be provided efficiently. An exemplary accident that can be prevented is as follows. An AC+DC charging roller for color is mistakenly set in a process cartridge having a lubricant applicator with a setting of the pressing force for black, and therefore a problem such as filming due to insufficient amount of the lubricant applied to the image carrier occurs. It should be noted that the pressing forces of the springs 553 and 653 can be changed not only by changing their length but also by changing any of their other settings, such as the spring wire diameter and the number of turns on the spring.

Further, in the first embodiment, frames 555 and 655, on which the springs 553 and 653 are mounted respectively, have observation windows 556 and 656, respectively. Through these observation windows 556 and 656, an operator can distinguish with the eye E the types of the springs 553 and 653 disposed in the lubricant applicators 550 and 650 by their colors. As an alternative for enabling observation of the spring with the eye, a transparent closed frame or an open frame covered with a transparent member may be used.

Figure 5A:
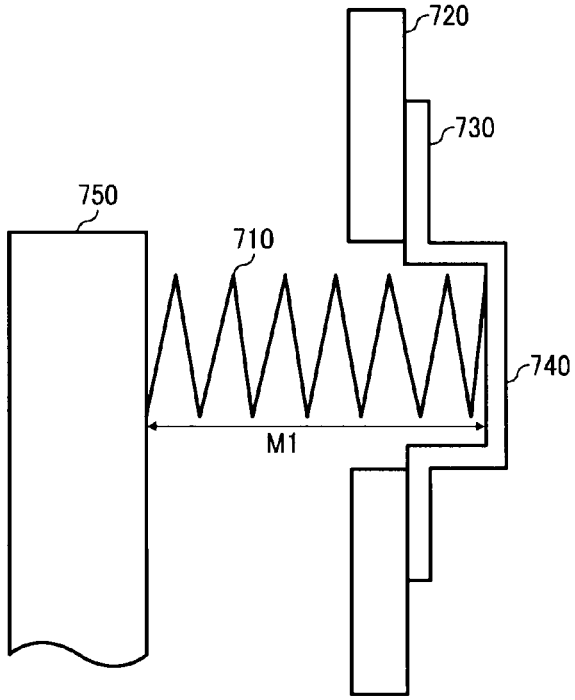
FIG. 5A is a cross-sectional view of a lubricant applicator according to a second embodiment in a case where the lubricant applicator is used in a process cartridge for black.
Figure 5B:
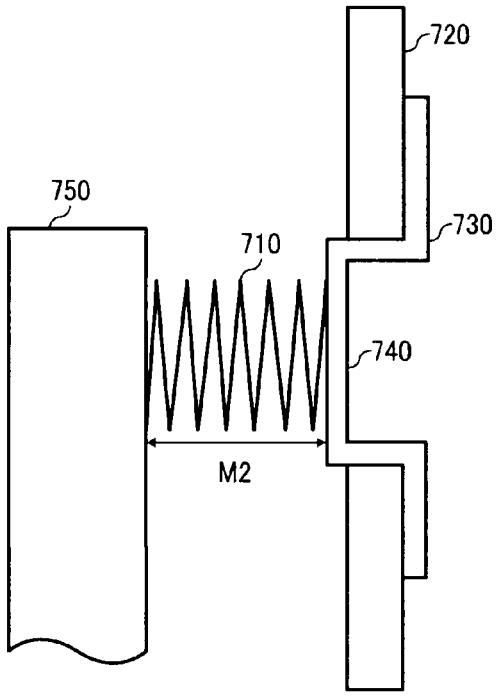
FIG. 5B is a cross-sectional view of a lubricant applicator according to the second embodiment in a case where the lubricant applicator is used in a process cartridge for yellow.

Next, a second embodiment of the invention will be described. FIGS. 5A and 5B are cross-sectional views of a lubricant applicator according to the second embodiment. FIG. 5A shows a case where the lubricant applicator is used in a process cartridge for black. FIG. 5B shows a case where the lubricant applicator is used in a process cartridge for yellow.

In the second embodiment, the process cartridge 500 for black and the process cartridge 600 for yellow, an example of the process cartridges for color, each includes the same pressing member, a spring 710. In the second embodiment, the spring 710 is set to a frame 720 with an adjustment member 730. As shown in FIGS. 5A and 5B, the adjustment member 730 is a plate-like member having a concave portion, which is a fitting portion 740. By changing the orientation of the fitting portion 740 when mounting the spring 710 on the frame 720, the length of the spring 710 can be changed.

In the second embodiment, to mount the lubricant applicator in the process cartridge 500 for black, the adjustment member 730 is attached to the frame 720 in such a manner that the fitting portion 740 projects away from a solid lubricant 750 as shown in FIG. 5A. In this case, the spring 710 disposed between the solid lubricant 750 and the adjustment member 730 has a length M1.

In contrast, to mount the lubricant applicator in the process cartridge 600 for yellow, the adjustment member 730 is attached to the frame 720 in such a manner that the fitting portion 740 projects toward the solid lubricant 750 as shown in FIG. 5B. In this case, the spring 710 disposed between the solid lubricant 750 and the adjustment member 730 has a length M2.

Here, since M1 is larger than M2, the tension of the spring 710 is lower in the case where it is used in the process cartridge 500 for black than in the case where it is used in the process cartridge 600 for yellow.

With such a configuration, the pressing force applied to the solid lubricant 750 by using the same spring 710 can be changed appropriately for the process cartridge 500 for black and for the process cartridge 600 for yellow.

In the second embodiment, by checking the orientation of the fitting portion 740 of the adjustment member 730, process cartridges can be easily distinguished between those for black and those for color. Moreover, all the process cartridges can have identical components except for the charger.

Figure 6A:
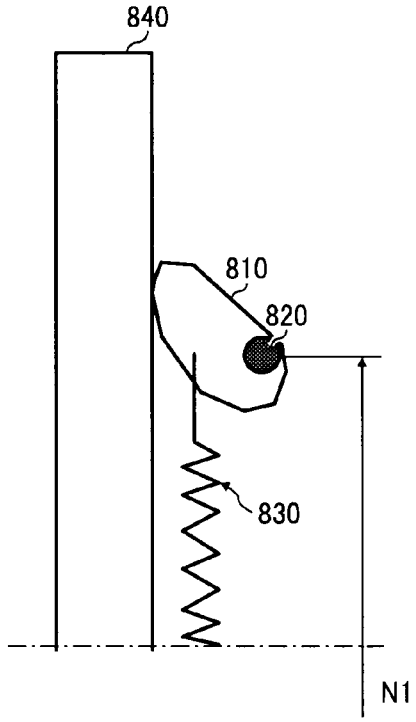
FIG. 6A schematically shows a lubricant applicator according to a third embodiment in a case where the lubricant applicator is used in a process cartridge for black.
Figure 6B:
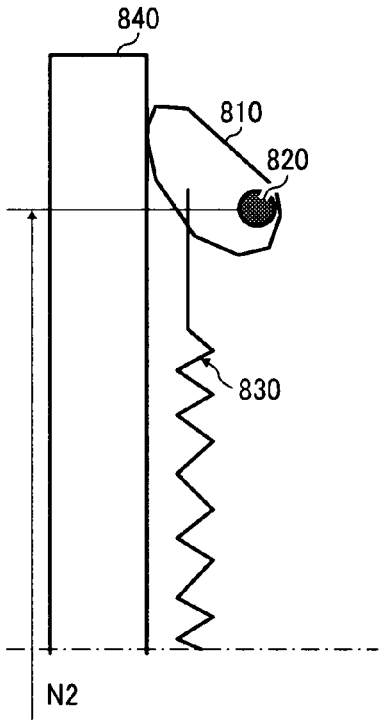
FIG. 6B schematically shows a lubricant applicator according to the third embodiment in a case where the lubricant applicator is used in a process cartridge for yellow.
Figure 7A:
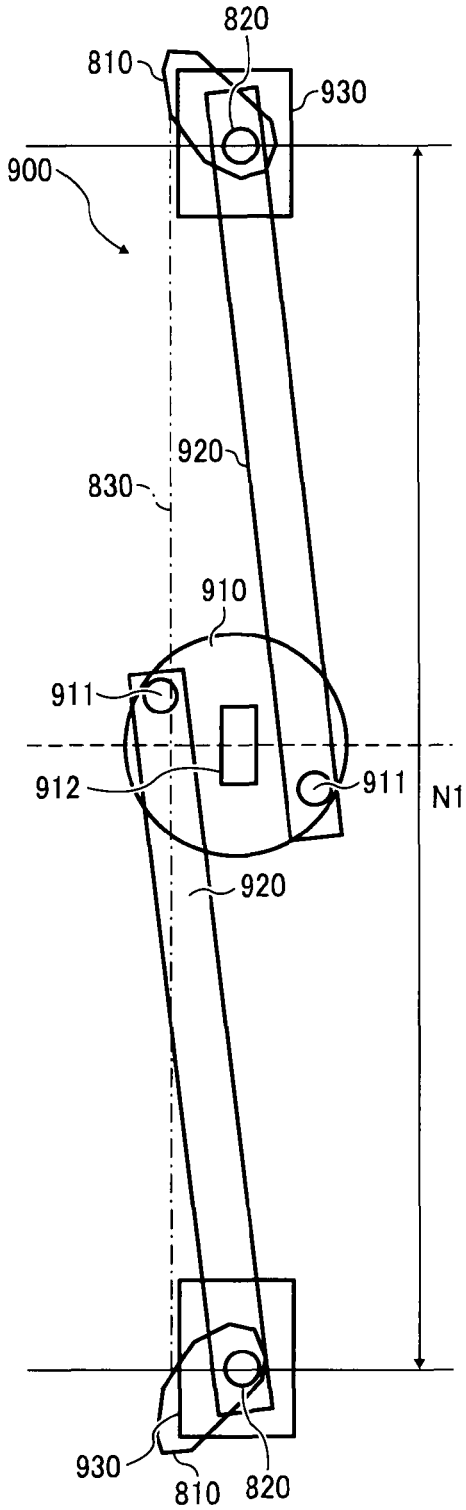
FIG. 7A schematically shows a pressing force changer in a case where the pressing force changer is included in the lubricant applicator shown in FIG. 6A.
Figure 7B:
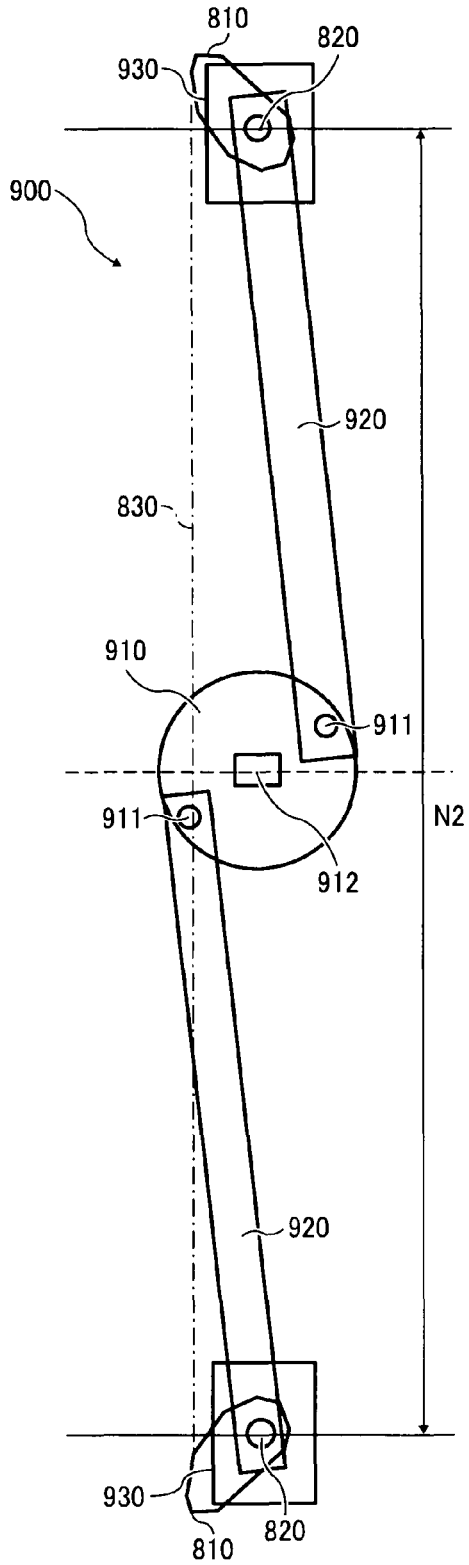
FIG. 7B schematically shows a pressing force changer in a case where the pressing force changer is included in the lubricant applicator shown in FIG. 6B.

Next, a third embodiment will be described. FIGS. 6A and 6B schematically show lubricant applicators according to the third embodiment. FIGS. 7A and 7B schematically show pressing force changers included in the lubricant applicator shown in FIGS. 6A and 6B, respectively. FIGS. 6A and 7A each shows a case where the lubricant applicator is used in a process cartridge for black. FIGS. 6B and 7B each shows a case where the lubricant applicator is used in a process cartridge for yellow.

In the third embodiment, two cams 810 (only one of the two is shown in FIGS. 6A and 6B) are disposed on a solid lubricant 840 at equal distances from the center of the solid lubricant 840. The cams 810 are each provided in a rotatable state with a shaft 820. A spring 830 is stretched between the cams 810 in such a manner as to urge the cams 810 in a direction in which the cams 810 press the solid lubricant 840. Further, the two shafts 820 are provided with a common pressing force changer 900 that changes the distance between the shafts 820.

Referring to FIGS. 7A and 7B, the pressing force changer 900 includes a rotary knob 910 and two arms 920. The arms 920 each has one end thereof being rotatably fastened to the rotary knob 910 with a pin 911, and the other end thereof being rotatably fastened to the shaft 820. Each of the shafts 820 is provided with a slider 930. When the rotary knob 910 is rotated, the shafts 820 move with the guide of the respective sliders 930, whereby the distance between the shafts 820 can be changed.

The rotary knob 910 has an indication member 912 that indicates the angle of rotation of the rotary knob 910. When the lubricant applicator is mounted in the process cartridge 500 for black, the rotary knob 910 is set in an orientation shown in FIG. 7A. In this case, the distance between the shafts 820 is a distance N1. When the lubricant applicator is mounted in the process cartridge 600 for yellow, an example of the process cartridges for color, the rotary knob 910 is set in an orientation shown in FIG. 7B. In this case, the distance between the shafts 820 is a distance N2. Here, since N1 is smaller than N2, the tension of the spring 830 (shown in two-dot chain lines in FIGS. 7A and 7B) is lower in the case where it is used in the process cartridge 500 for black in the case where it is used in the process cartridge 600 for yellow.

In the third embodiment, pressing forces equal to each other are applied to the solid lubricant 840 at two positions by the use of two cams 810. Therefore, the solid lubricant 840 is pressed uniformly against the lubricant applying member. In addition, the pressing force applied to the solid lubricant 840 can be identified by visually checking the orientation of the indication member 912 of the rotary knob 910. Therefore, it is easy to identify whether the pressing force changer 900 is set for the process cartridge 500 for black or for the process cartridge 600 for yellow.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape, are not limited the embodiments and thus may be set as preferred. It is therefore to be understood that, within the scope of the appended claims, the disclosure of this patent specification may be practiced otherwise than as specifically described herein.

What is claimed is:

1. An image forming apparatus comprising:

a plurality of process cartridges provided for black and for another color, the process cartridges, each comprising:

a set of a latent image carrier;

a charging unit configured to charge a surface of the latent image carrier; and a lubricant applying unit configured to apply lubricant to the surface of the latent image carrier, wherein the process cartridges for black and for the another color each having a cartridge frame with which the process cartridge is attachable to and removable from an apparatus body, and the cartridge frames of the process cartridges for black and for the another color being of the same type, and wherein the process cartridge for black differs from the process cartridge for the another color in the configuration of the charging unit, and amounts of lubricant applied by the lubricant applying units to the respective latent image carriers differ with respect to the configuration of the charging unit.

2. The image forming apparatus according to claim 1, wherein the lubricant applying units each includes a solid lubricant, an applying member that scrapes the solid lubricant and applies the scraped lubricant to the latent image carrier while being in contact with both the solid lubricant and the latent image carrier, and a pressing mechanism that presses the solid lubricant against the applying member, and wherein the lubricant applying unit changes the amount of lubricant to be applied to the latent image carrier by changing a pressing force of the pressing mechanism.

3. The image forming apparatus according to claim 2, wherein the pressing mechanism presses the solid lubricant at a plurality of positions on the solid lubricant.

4. The image forming apparatus according to claim 2, wherein the pressing mechanism includes a plurality of springs that press the solid lubricant, and wherein the springs are selected from springs of different types prepared with pressing forces that differ with respect to the type.

5. The image forming apparatus according to claim 4, wherein the springs of different types have surface colors that differ with respect to the type.

6. The image forming apparatus according to claim 4, wherein the lubricant applying unit is configured in such a manner that the springs disposed therein are observable from an outside.

7. The image forming apparatus according to claim 2, wherein the pressing mechanism includes a spring that presses the solid lubricant and a holding member that holds a base of the spring, and wherein the holding member has a shape capable of producing two initial lengths, long and short, of the spring by changing an orientation of the holding member, the orientation of the holding member being selected in accordance with the amount of lubricant to be applied.

8. The image forming apparatus according to claim 2, wherein the pressing mechanism includes:

two cams rotatably supported by respective shafts and disposed in such a manner as to be spaced apart from each other while being each in contact at one end thereof with the solid lubricant;

a spring stretched between the cams and urging the cams in a direction in which the cams rotate so as to press the solid lubricant; and a pressing force changer that changes the pressing force applied to the solid lubricant by the cams with the use of the spring, the pressing force being changeable by changing a distance between the shafts supporting the cams.

9. The image forming apparatus according to claim 8, wherein the pressing force changer includes a knob whose orientation is changeable manually, and a link that changes the distance between the shafts when the orientation of the knob is changed.

10. A process cartridge used for formation of an image of black or of another color, the process cartridge comprising:

a set of a latent image carrier;

a charging unit configured to charge a surface of the latent image carrier; and a lubricant applying unit configured to apply lubricant to the surface of the latent image carrier, wherein the process cartridge has a cartridge frame with which the process cartridge is attachable to and removable from an apparatus body, the cartridge frame being of the same type for both cases where the process cartridge is used for black and the another color, and wherein the configuration of the charging unit differs between a case where the process cartridge is used for black and a case where the process cartridge is used for the another color, and an amount of lubricant to be applied by the lubricant applying unit to the latent image carrier differs with respect to the configuration of the charging unit.

11. The process cartridge according to claim 10, wherein the lubricant applying unit includes a solid lubricant, an applying member that scrapes the solid lubricant and applies the scraped lubricant to the latent image carrier while being in contact with both the solid lubricant and the latent image carrier, and a pressing mechanism that presses the solid lubricant against the applying member, and wherein the lubricant applying unit changes the amount of lubricant to be applied to the latent image carrier by changing a pressing force of the pressing mechanism.

12. The process cartridge according to claim 11, wherein the pressing mechanism presses the solid lubricant at a plurality of positions on the solid lubricant.

13. The process cartridge according to claim 11, wherein the pressing mechanism includes a plurality of springs that press the solid lubricant, and wherein the springs are selected from springs of different types prepared with pressing forces that differ with respect to the type.

14. The process cartridge according to claim 13, wherein the springs of different types have surface colors that differ with respect to the type.

15. The process cartridge according to claim 13, wherein the lubricant applying unit is configured in such a manner that the springs disposed therein are observable from an outside.

16. The process cartridge according to claim 11, wherein the pressing mechanism includes a spring that presses the solid lubricant and a holding member that holds a base of the spring, wherein the holding member has a shape capable of producing two initial lengths, long and short, of the spring by changing an orientation of the holding member, the orientation of the holding member being selected in accordance with the amount of lubricant to be applied.

17. The process cartridge according to claim 11, wherein the pressing mechanism includes two cams rotatably supported by respective shafts and disposed in such a manner as to be spaced apart from each other while being each in contact at one end thereof with the solid lubricant;

a spring stretched between the cams and urging the cams in a direction in which the cams rotate so as to press the solid lubricant; and a pressing force changer that changes the pressing force applied to the solid lubricant by the cams with the use of the spring, the pressing force being changeable by changing a distance between the shafts supporting the cams.

18. The process cartridge according to claim 17, wherein the pressing force changer includes a knob whose orientation is changeable manually and a link that changes the distance between the shafts when the orientation of the knob is changed.

19. The process cartridge according to claim 10, wherein:

a DC charging method is used in the configuration for formation of the image of black and an AC+DC charging method is used in the configuration for formation of the image of another color; and an amount of the lubricant to be applied in the configuration for the formation of the image of black is less than an amount of the lubricant to be applied in the configuration for the formation of the image of another color.

20. The process cartridge according to claim 10, wherein:

a charge wire is used in the configuration for formation of the image of black and a charging roller is used in the configuration for formation of the image of another color.

* * * * *